US006526227B2

(12) United States Patent
Choi

(10) Patent No.: US 6,526,227 B2
(45) Date of Patent: Feb. 25, 2003

(54) RADIANT ELECTRIC HEATER

(75) Inventor: Gun-Young Choi, Incheon-shi (KR)

(73) Assignees: IC Tech Co., Ltd., Incheon-shi (KR); Key-Young Choi, Incheon-shi (KR)

( * ) Notice: Subject to any disclaimer, the term of this patent is extended or adjusted under 35 U.S.C. 154(b) by 0 days.

(21) Appl. No.: 10/082,145

(22) Filed: Feb. 26, 2002

(65) Prior Publication Data

US 2002/0118961 A1 Aug. 29, 2002

(30) Foreign Application Priority Data

Feb. 27, 2001 (KR) ..... 2001-10112

(51) Int. Cl.[7] ..... F24C 7/06; F24C 15/22; F25D 5/02

(52) U.S. Cl. ..... 392/422; 392/376; 392/373; 219/541; 219/548

(58) Field of Search ..... 392/422, 421, 392/426–429, 376, 373; 219/541, 548

(56) References Cited

U.S. PATENT DOCUMENTS

| | | | | |
|---|---|---|---|---|
| 4,164,642 A | | 8/1979 | Ebert | |
| 5,652,826 A | | 7/1997 | Mills | |
| 6,188,836 B1 | * | 2/2001 | Glucksman et al. | 392/376 |
| 6,205,677 B1 | * | 3/2001 | Yune | 34/266 |
| 6,453,121 B2 | * | 9/2002 | Choi | 392/376 |
| 2002/0003952 A1 | * | 1/2002 | Choi | 392/376 |

FOREIGN PATENT DOCUMENTS

| | | | |
|---|---|---|---|
| DE | 382099 | * | 9/1923 |
| DE | 820732 | * | 11/1951 |
| DE | 2950001 | * | 6/1981 |
| EP | 577196 | * | 1/1994 |
| FR | 1230451 | * | 9/1960 |
| KR | 1998-61527 A | | 11/1998 |
| WO | 9103915 | * | 3/1991 |
| WO | 00/00055 | * | 1/2000 |

* cited by examiner

*Primary Examiner*—John A. Jeffery
(74) *Attorney, Agent, or Firm*—Smith Patent Office

(57) ABSTRACT

A radiant electric heater is disclosed having an auxiliary reflector in front of a halogen lamp. The heater includes a ceramic base defined with clampling grooves for directly clamping terminals of the halogen lamp. The auxiliary reflector has a concave surface outline which faces a curved front end of the halogen lamp. The heater also includes a fastening member having one end which is affixed to the auxiliary reflector and the other end which is affixed to a center portion of the safety grill.

2 Claims, 7 Drawing Sheets

RADIANT ELECTRIC HEATER

BACKGROUND OF THE INVENTION

1. Field of the Invention

The present invention relates to an electric heater, and more particularly, the present invention relates to a radiant electric heater in which terminals of a halogen lamp are clamped with respect to a ceramic base secured to a reflector, and an auxiliary reflector is arranged in front of the halogen lamp, so that a heat reflection efficiency and durability of the radiant electric heater are improved.

2. Description of the Related Art

With the improvement of living standards, as a room heating arrangement, electric heaters have widely been used throughout the world, in place of oil heaters. In order to meet diverse market demand, various kinds of electric heaters have been developed.

As is well known in the art, a basic principle of an electric heater is to warm surrounding air with heat generated by applying a current to a heating wire which is disposed in a space delimited by a safety guard or grill. The electric heater is provided with appurtenances or its associated elements for efficiently radiating heat generated from the heating wire. As a typical example, an electric heater, in which a reflection plate prepared by bending a quadrangular thin metal sheet is placed behind the heating wire, has been pervaded, but a satisfactory effect is not obtained. This type of electric heater has a problem in that heat cannot be transferred to a desired far distance. In the case that a large current is applied to the electric heater to transfer heat to the desired far distance, dangers of overheating and electrical fire may be accompanied. On the contrary, in the case that a small current is applied to the electric heater to avoid any possible accident, it is difficult to generate a sufficient amount of heat.

In order to cope with the problem involved in the above-mentioned conventional electric heater, in Korean Utility Model Laid-open Publication No. 98-61527, there is disclosed a radiant electric heater capable of transferring an appropriate amount of heat to a desired far distance to warm room air to a sufficient degree. In such a radiant electric heater, a semi-spherical or parabolic reflector is arranged behind a heating wire, and a diameter of a heating wire mounting member on which the heating wire is wound is gradually decreased toward a rear end of the heater, so that heat is not diffused toward all directions but concentrated in a narrow range, and thereby, can be transferred to the desired far distance.

Concretely speaking with reference to FIGS. 1 and 2, a radiant electric heater 1 largely comprises a heating part 10 including a heating wire 12, and a support part 20. The support part 20 has a support base 21 in which main circuits for controlling operation of the radiant electric heater 1 are built in. A power control knob 22 for power supply or power cut-off, a temperature adjustment knob 23 for adjusting a temperature of the heating wire 12, a power connection indicator lamp 24, a safety switch 29 for cutting off power supply to the heating wire 12 when the heater 1 is tilted, and an alarm lamp 25 for calling attention to dangerous tilting of the heater 1, and so forth, are installed on rear and front portions of the support base 21.

The heating part 10 is connected to a support column 26 of the support base 21 via a retractable rod 27. By pressing a height adjustment button 28, the retractable rod 27 can be retracted into or extended from the support column 26. That is, an overall height of the radiant electric heater 1 can be adjusted as desired.

Referring to FIG. 2 which is a partial side cross-sectional view illustrating the heating part 10 of the heater 1, the heating part 10 includes the heating wire 12 which is wound around a heating wire mounting member 11 having a predetermined configuration, a reflector 13 which is arranged behind the heating wire 12, a safety grill 14 which is coupled to the reflector 13 and defines a front contour of the entire heating part 10, and a support case 15 which is connected to a rear end of the reflector 13. The heating wire 12 is connected to the reflector 13 by the medium of a bracket 16, and a heat sensor 17 is fixed to a front surface of the reflector 13 at a predetermined location.

In the construction of the radiant electric heater 1, as stated above, unlike the first-mentioned conventional electric heater in which heat is diffused toward all directions, heat rays emitted from the heating wire 12 and designated by the reference character a are concentrated in a predetermined range C due to the presence of the reflector 13. As a consequence, heat can be transferred to a desired far distance. At this time, due to the fact that the heat rays a do not remain around the heating part 10 including the heating wire 12 but are emitted through a reflecting function of the reflector 13, the safety grill 14 is prevented from being overheated.

A maximum heat ray convergence can be accomplished in the case where the reflector 13 has a semi-spherical surface outline such as seen in a conventional concave mirror, or a parabolic surface outline having substantially a concave center portion.

The heating wire mounting member 11, around which the heating wire 12 is wound and which is made of a heat-resistant material such as a ceramic, and the like, has a configuration of a truncated cone which is gradually decreased in its diameter toward a rear end thereof. Due to this fact, all heat rays a from the heating wire 12 are directed toward the reflector 13, and therefore, it is possible to prevent any of the heat rays a from diffusing out of the predetermined range C. The heating wire mounting member 11 may have a configuration of a polygonal pyramid such as a trigonal pyramid, etc. Hence, it is sufficient that the heating wire mounting member 11 has a diameter which is gradually decreased in a rearward direction.

While this type of radiant electric heater 1 exhibits an increased heat efficiency, it still suffers from defects in that, since the heating wire 12 for generating heat is shaped in the form of a coil, the heating wire 12 is likely to be corroded when it is used for a lengthy period of time, and thereby, durability of the heater 1 can be deteriorated and fire can be caused. Further, because the heating wire 12 is directly wound around the heating wire mounting member 11 made of a ceramic, as the ceramic which directly receives heat is overheated, a far infrared ray irradiation efficiency can be lowered.

SUMMARY OF THE INVENTION

Accordingly, the present invention has been made in an effort to solve the problems occurring in the related art, and an object of the present invention is to provide a radiant electric heater which utilizes as its heat source (that is, heat generation means) a halogen lamp, and in which an auxiliary reflector is arranged in front of the halogen lamp in a safety grill, so that a heat reflection efficiency is improved due to additional heat reflection by the auxiliary reflector and a far infrared ray irradiation efficiency is improved because a ceramic base receives radiant heat from the halogen lamp in such a way as not to be overheated.

Another object of the present invention is to provide a radiant electric heater in which terminals of a halogen lamp are clamped in clamping grooves defined in a ceramic base to simplify a clamping work, a front surface of an auxiliary reflector is coated with a ceramic to improve a far infrared ray irradiation efficiency, and each terminal and a clamper therefor are commonly accommodated in each clamping groove to improve a shock-absorbing characteristic.

To these ends, in the present invention, a halogen lamp is utilized as heat generation means, and an auxiliary reflector is spacedly arranged in front of the halogen lamp to allow transfer of an increased amount of radiant heat. The auxiliary reflector is fastened with respect to a safety grill to ease an assembling work. A front surface of the auxiliary reflector is coated with a ceramic to improve a far infrared ray irradiation efficiency. Terminals of the halogen lamp are accommodated and clamped in clamping grooves defined in a ceramic base. The ceramic base does not directly receive heat generated from the halogen lamp but indirectly receives radiant heat emitted therefrom to improve a far infrared ray irradiation efficiency.

In order to achieve the first object, according to one aspect of the present invention, there is provided a radiant electric heater, including a reflector, heat generation means disposed on the reflector, and a safety grill coupled to a front end of the reflector, comprising: a ceramic base defined with clamping grooves for directly clamping terminals of a halogen lamp serving as the heat generation means, the ceramic base receiving radiant heat from the halogen lamp, being indirectly heated by the radiant heat and irradiating far infrared rays, the ceramic base being secured to a center portion of the reflector; an auxiliary reflector spacedly arranged in front of the halogen lamp and having a concave surface outline which faces a curved front end of the halogen lamp, for primarily reflecting heat rays toward the reflector, the auxiliary reflector possessing a size capable of covering the curved front end of the halogen lamp; and a fastening member having one end which is affixed to the auxiliary reflector and the other end which is affixed to a center portion of the safety grill.

In order to achieve the second object, according to another aspect of the present invention, there is provided a radiant electric heater, including a reflector, heat generation means disposed on the reflector, and a safety grill coupled to a front end of the reflector, comprising: a ceramic base defined with clamping grooves for directly clamping terminals of a halogen lamp serving as the heat generation means, the ceramic base receiving radiant heat from the halogen lamp, being indirectly heated by the radiant heat and irradiating far infrared rays; an auxiliary reflector spacedly arranged in front of the halogen lamp and having a concave surface outline which faces a curved front end of the halogen lamp, for primarily reflecting heat rays toward the reflector, the auxiliary reflector possessing a size capable of covering the curved front end of the halogen lamp and being applied on a front surface thereof (opposing to a reflecting surface) with a ceramic coating layer; a fastening member having one end which is affixed to the auxiliary reflector and the other end which is affixed to a center portion of the safety grill; and dampers loosely accommodated, along with the terminals of the halogen lamp, in the clamping grooves of the ceramic base; each damper comprising a pair of leg portions accommodated in the clamping groove, each separated by a predetermined distance from the terminal of the halogen lamp, and having one ends fixed to the ceramic base, and a clamping band portion integrally joined to the other ends of the leg portions and having a diameter which is less than an interval measured between the leg portions, for clamping a portion of the halogen lamp, which portion is adjacent to the terminal.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
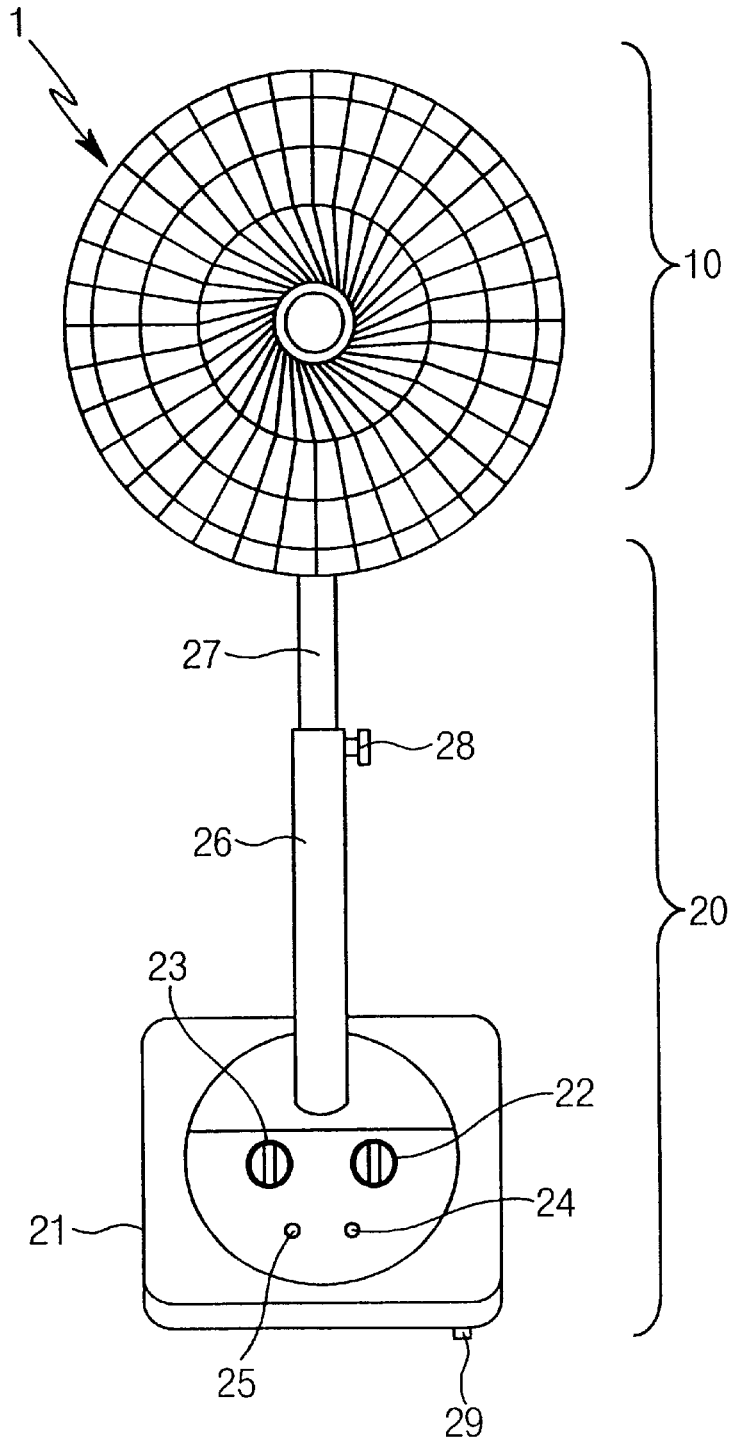
FIG. 1 PRIOR ART
FIG. 1 is a front view illustrating a conventional electric heater.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 3:
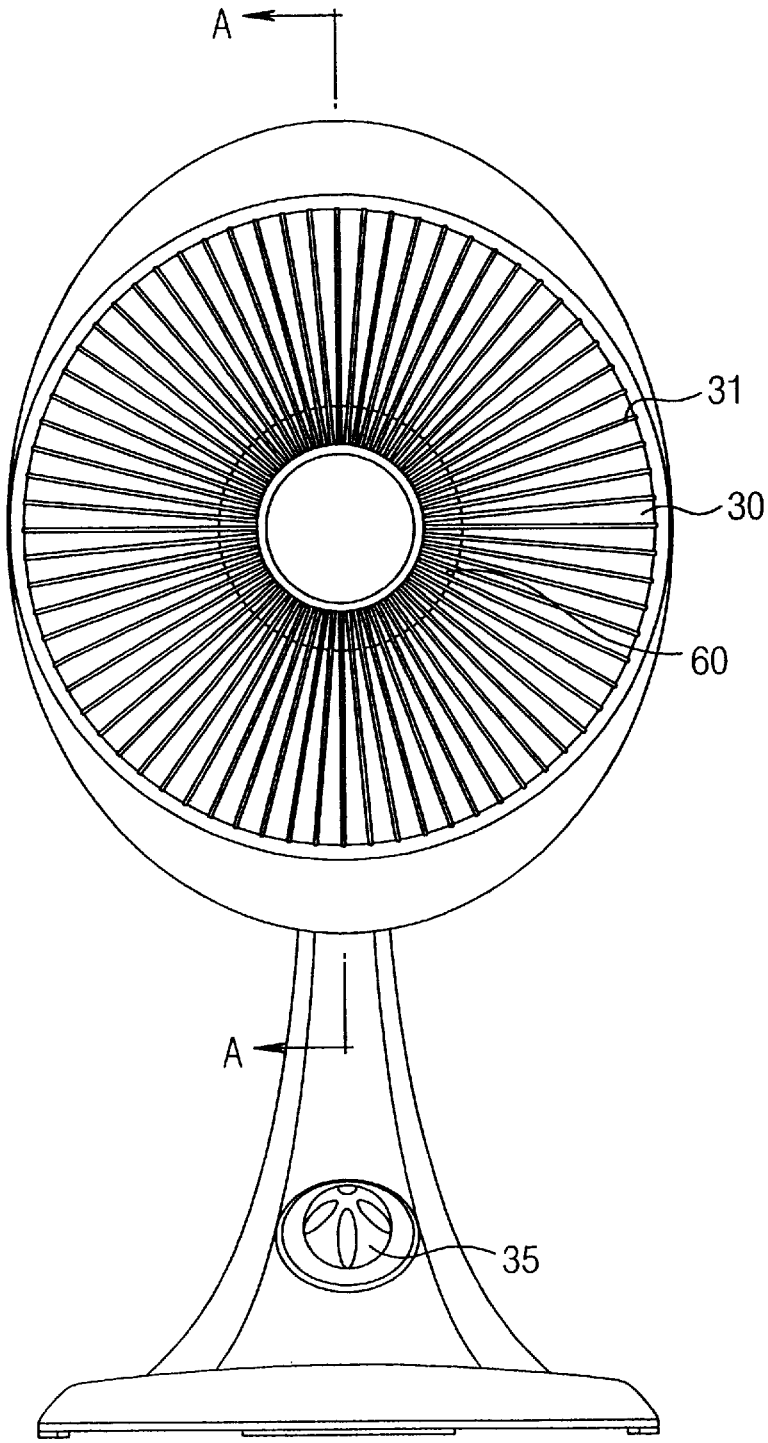
FIG. 3 is a front view illustrating a radiant electric heater in accordance with a first embodiment of the present invention.
Figure 4:
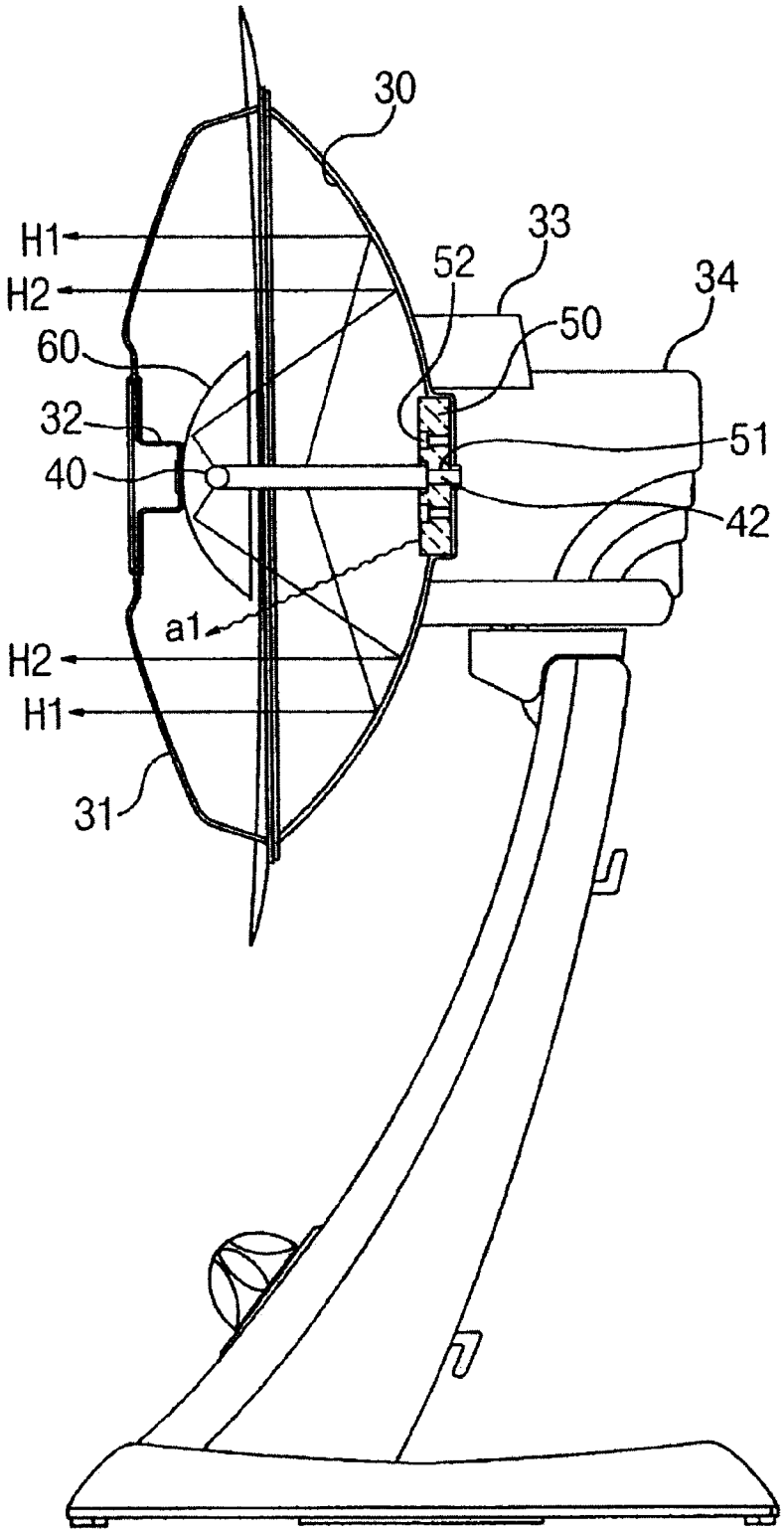
FIG. 4 is a side cross-sectional view taken along the line A—A of FIG. 3.
Figure 5:
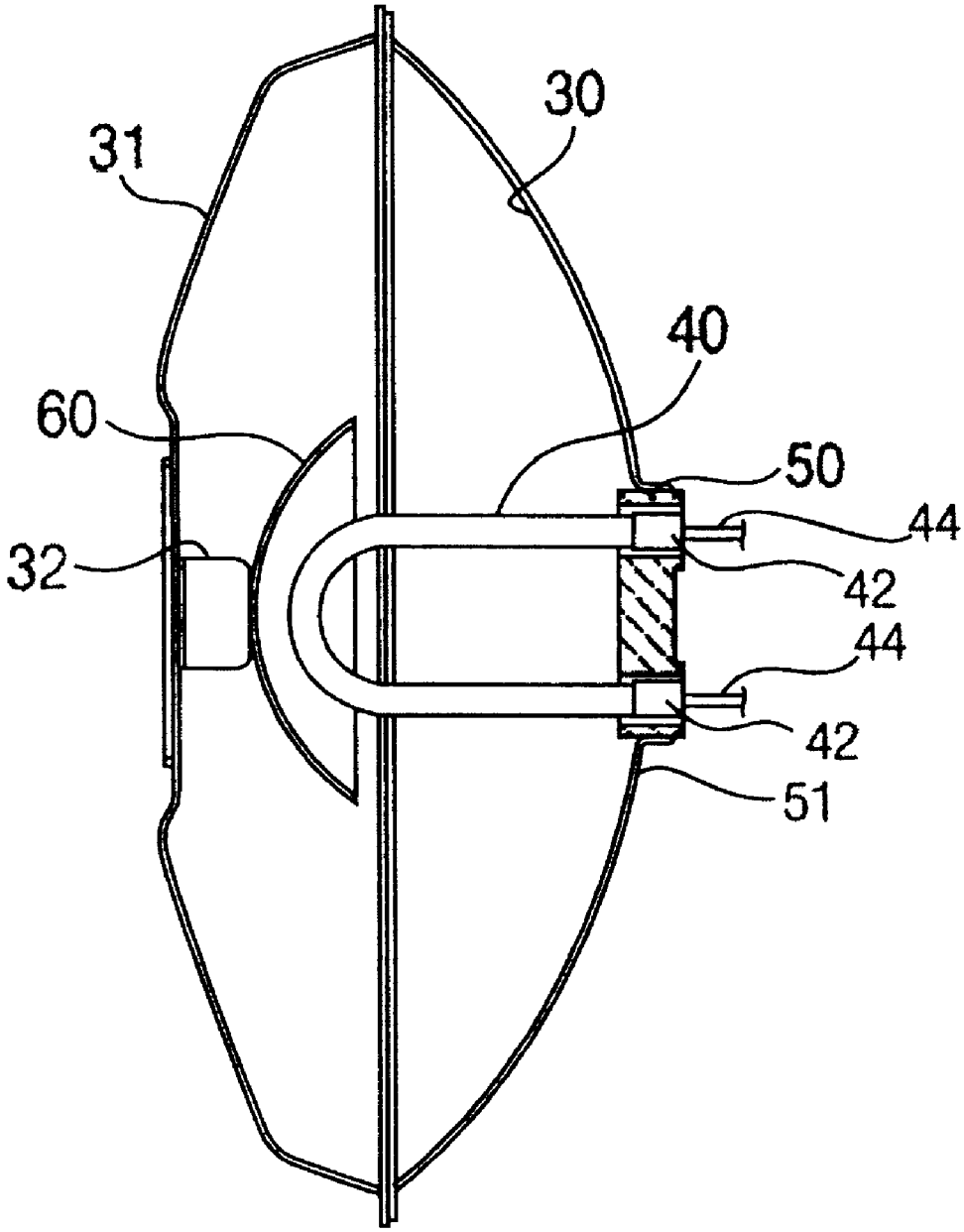
FIG. 5 is a partial transverse cross-sectional view of FIG. 4.

FIG. 3 is a front view illustrating a radiant electric heater in accordance with a first embodiment of the present invention; FIG. 4 is a side cross-sectional view taken along the line A—A of FIG. 3; and FIG. 5 is a partial transverse cross-sectional view of FIG. 4. The radiant electric heater according to the present invention includes a reflector 30, a halogen lamp 40 disposed on the reflector 30 and serving as heat generation means, and a safety grill 31 coupled to a front end of the reflector 30. The radiant electric heater according to the present invention further includes a ceramic base 50, an auxiliary reflector 60, and a fastening member 32. The ceramic base 50 is secured to the reflector 30 to permit power supply to the halogen lamp 40. The ceramic base 50 is defined with clamping grooves 51 for clamping terminals 42 which are formed at free portions of the halogen lamp 40 having a U-shaped configuration. The auxiliary reflector 60 is spacedly arranged in front of the halogen lamp 40 to face a curved front end of the halogen lamp 40, and functions to primarily reflect heat rays toward the reflector 30. The fastening member 32 has one end which is affixed to the auxiliary reflector 60 and the other end which is affixed to a center portion of the safety grill 31.

The halogen lamp 40 is clamped to the ceramic base 50 serving as a halogen lamp fixing plate, in a manner such that the halogen lamp 40 is electrically insulated from the reflector 30, and is supplied with power through wires 44. The ceramic base 50 is brought into contact with the reflector 30, and a size of the ceramic base 50 can be adjusted. In FIG. 4, the reference numeral 51 designates the clamping grooves for clamping the halogen lamp 40 with respect to the ceramic base 50, 52 screws for securing the ceramic base 50 to the reflector 30, and 33 a grip grasped upon moving the radiant electric heater. It is desirable that the grip 33 is integrally formed on an upper surface of a support case 34 for supporting the reflector 30 in a rear position.

The auxiliary reflector 60 is spacedly arranged in front of the halogen lamp 40, and has a concave surface which faces the curved front end of the halogen lamp 40, in a manner such that heat generated by the halogen lamp 40 can be primarily reflected toward the reflector 30 while being prevented from being diffused outward.

In the radiant electric heater according to the present invention, by driving the screws 52 through threaded holes defined in the ceramic base 50 into the reflector 30, the ceramic base 50 serving as the halogen lamp fixing plate is secured to the reflector 30 by means of the screws 52. The terminals 42 of the halogen lamp 40 are accommodated in the clamping grooves 51 of the ceramic base 50 and then, connected with power lines (not shown), respectively. At this time, the clamping grooves 51 are defined to have slits on their bottom surfaces, in a manner such that both free portions of the halogen lamp 40 which are adjacent to the terminals 42 are accommodated in the clamping grooves 51, and the terminals 42 are fitted through the slits, respectively. In this connection, it is to be readily understood from the drawings that each of the free portions has a circular cross-section and each terminal 42 has a flattened configuration. The fastening member 32 is affixed at the other end thereof to the center portion of the safety grill 31 (by welding, screws, etc.) which is coupled to the front end of the reflector 30. The auxiliary reflector 60 is joined to the one end of the fastening member 32 in a manner such that the concave surface of the auxiliary reflector 60 faces the curved front end of the halogen lamp 40. Of course, it is to be noted that the auxiliary reflector 60 is spaced apart from the curved front end of the halogen lamp 40 not to be brought into contact therewith. In the radiant electric heater according to the present invention, constructed as described above, if power is supplied to the halogen lamp 40 by manipulating an adjustment knob 35, the halogen lamp 40 generates heat. One part of heat rays (designated by the reference symbol H1), which are emitted from the halogen lamp 40, are directly applied to the reflector 30 thereby to provide radiant heat to a user. The other part of the heat rays (designated by the reference symbol H2), which are emitted from the halogen lamp 40, are primarily reflected on the auxiliary reflector 60 and then secondarily reflected on the reflector 30 to provide additional radiant heat to the user. That is to say, as can be readily seen from FIG. 2, in the conventional art, only the heat rays H1 initially directed toward the reflector can be reflected by the reflector. However, in the present invention, in addition to the heat rays H1, the heat rays H2, which are emitted outward in a state wherein they are not reflected by the reflector 30, are redirected toward the reflector 30 by the presence of the auxiliary reflector 60. As a consequence, in the present invention, since an overall amount of heat rays reflected from the reflector 30 is significantly increased in comparison with the case of the conventional art, a heat generation efficiency is markedly improved. At this time, due to the fact that the auxiliary reflector 60 defines the concave surface which faces the halogen lamp 40, the radiant heat is not diffused and instead concentrated on the reflector 30, whereby a heat reflection efficiency is also increased.

Also, because the auxiliary reflector 60 is spacedly arranged in front of the halogen lamp 40, it is possible to prevent access of a child to the halogen lamp 40, using an elongate object such as a chop stick, whereby the halogen lamp 40 is protected against damage or breakage. Further, since the ceramic base 50 is secured to the reflector 30 at a reduced height in comparison with the conventional structure, installation can be easily implemented.

Figure 2:
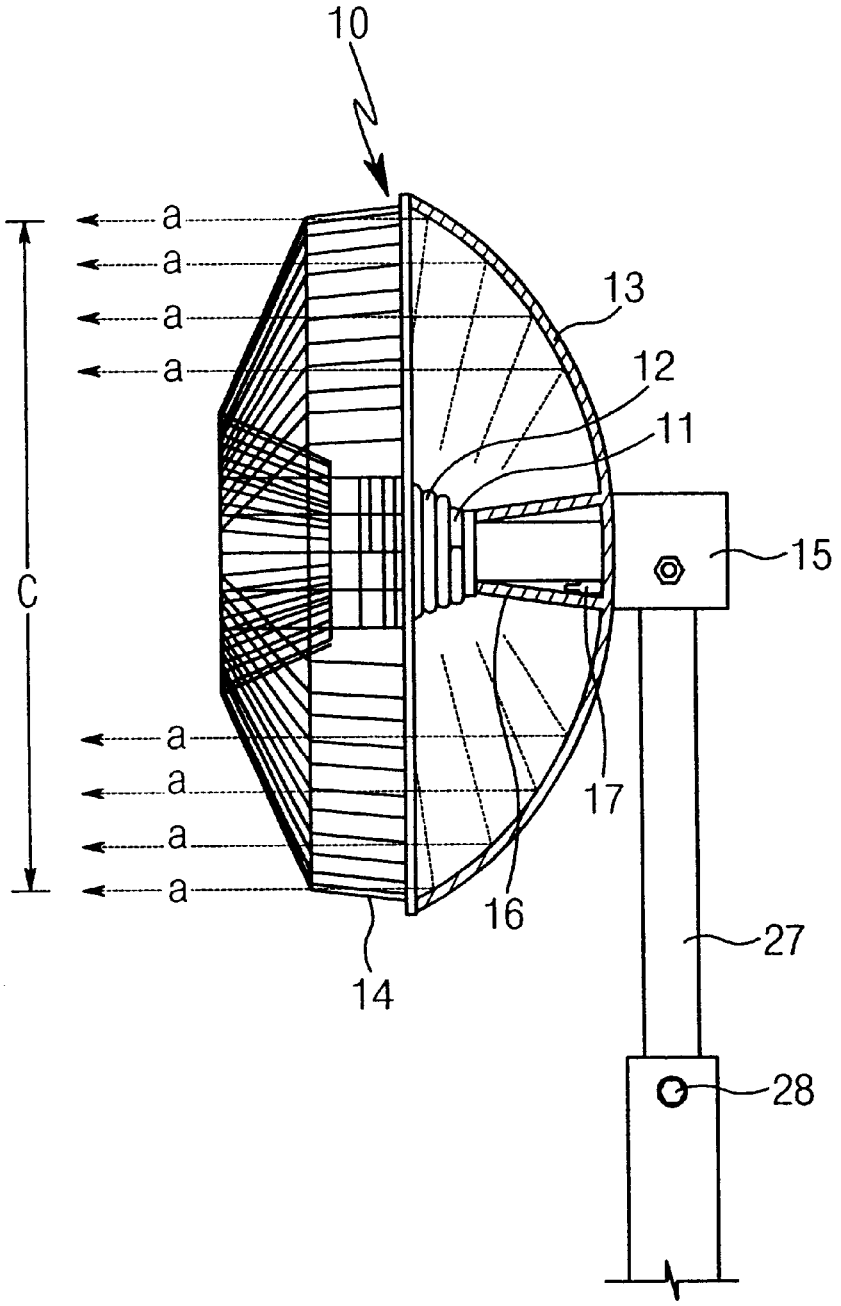
FIG. 2 PRIOR ART
FIG. 2 is a partial side cross-sectional view of FIG. 1.

Moreover, in the present invention, the one part of the heat rays emitted from the halogen lamp 40 is primarily reflected on the auxiliary reflector 60 and then secondarily reflected on the reflector 30. In this way, the heat rays emitted from the halogen lamp 40 are applied to the ceramic base 50 as indirect radiant heat rays. Thus, while, in the conventional art as shown in FIG. 1 and 2, the heating wire 12 is directly wound around the heating wire mounting member 11 and thereby overheated to about 700° C., in the present invention, far infrared rays designated by the reference symbol al are irradiated under a low temperature of no greater than 300° C. due to the indirect radiant heat (that is, since the ceramic base 50 does not directly receive heat from the halogen lamp 40 but receives indirect radiant heat). Hence, in consideration of the fact that a far infrared ray irradiation efficiency is increased under a low temperature rather than a high temperature, the present invention achieves an improved far infrared ray irradiation efficiency. In addition, because a difference between maximum and minimum temperatures is small, it is possible to prevent the ceramic base 50 from being thermally damaged, whereby durability of the entire radiant electric heater is enhanced.

Figure 6:
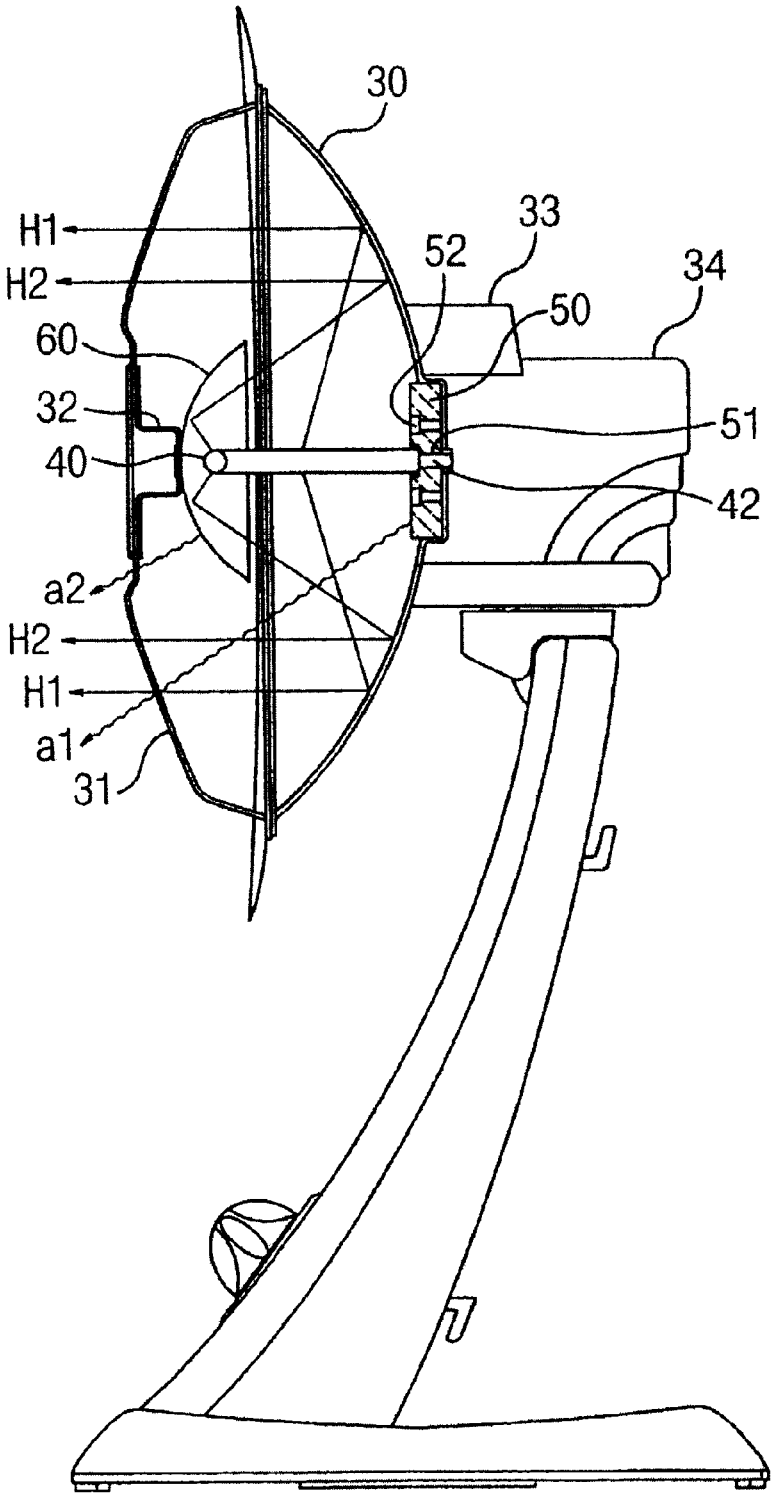
FIG. 6 is a side cross-sectional view illustrating a radiant electric heater in accordance with a second embodiment of the present invention.
Figure 7:
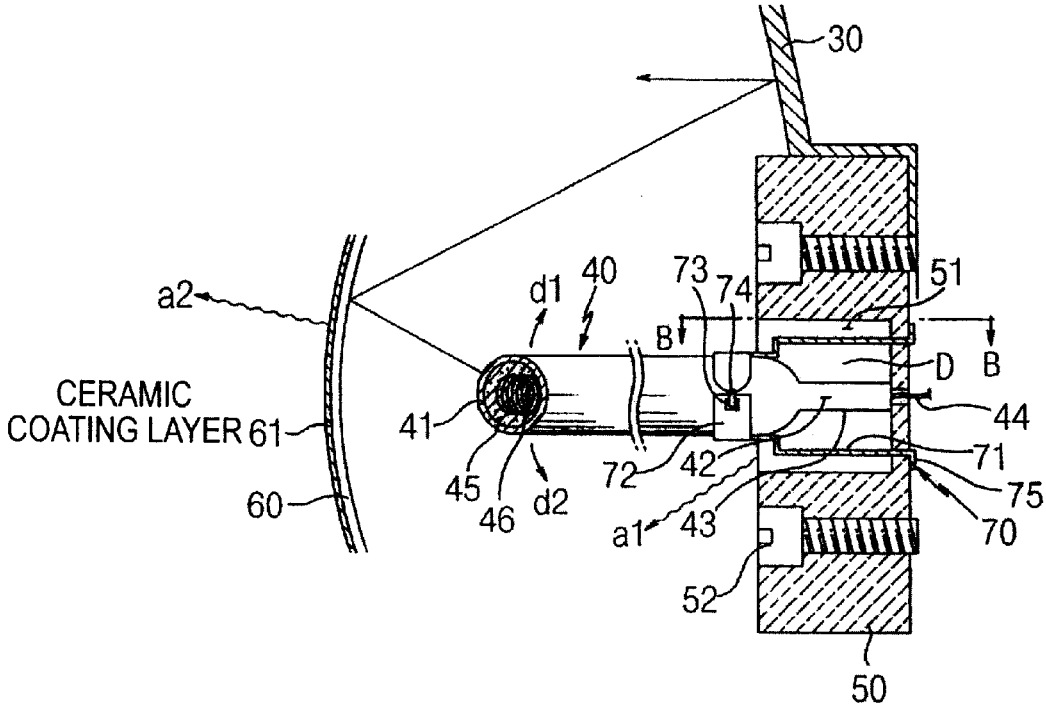
FIG. 7 is a partial enlarged cross-sectional view of FIG. 6.

FIG. 6 is a side cross-sectional view illustrating a radiant electric heater in accordance with a second embodiment of the present invention; and FIG. 7 is a partial enlarged cross-sectional view of FIG. 6. In this second embodiment of the present invention, a front surface of the auxiliary reflector 60 is applied with a ceramic coating layer 61, the ceramic base 50 is defined with the clamping grooves 51 for clamping the halogen lamp 40, and halogen lamp dampers 70 and the terminals 42 of the halogen lamp 40 are simultaneously accommodated in the clamping grooves 51 in such a way as to absorb vibration or shock.

In one example, each damper 70 comprises a pair of leg portions 71 and a clamping band portion 72. The leg portions 71 are accommodated in the clamping groove 51 and fitted through a bottom wall of the clamping groove 51 to be securely placed therein. Each leg portion 71 is separated by a predetermined distance D from a flattened surface 43 of the terminal 42 of the halogen lamp 40. The leg portions 71 have one ends fixed to the ceramic base 50. The clamping band portion 72 is integrally joined to the other ends of the leg portions 71 to define a ring-shaped configuration. The clamping band portion 72 functions to clamp a portion of the halogen lamp 40, which portion is adjacent to the terminal 42. Each leg portion 71 is separated from the terminal 42 of the halogen lamp 40 by the predetermined distance D so as to be capable of absorbing shock. To clamp the halogen lamp 40, the clamping band portion 72 defines an opening 73 and has a clamping tongue 74. The reference numeral 41 designates a glass tube of the halogen lamp 40, 45 halogen gas, and 46 a heating coil. The one ends of the leg portions 71 are fitted through the bottom wall of each clamping groove 51 and then bent outward to form fixing lips 75.

Figure 8:
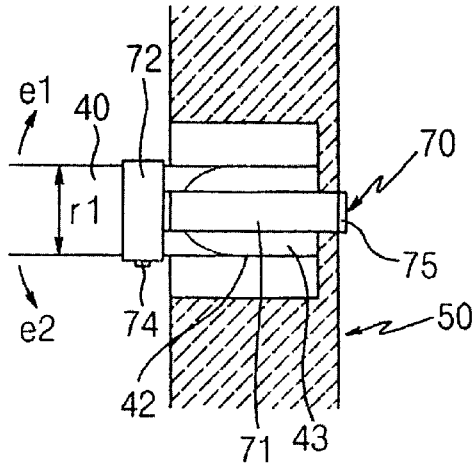
FIG. 8 is a transverse cross-sectional view taken along the line B—B of FIG. 7.

FIG. 8 is a transverse cross-sectional view taken along the line B—B of FIG. 7. The clamping grooves 51 of the ceramic base 50 are defined in a manner such that the terminals 42 of the halogen lamp 40 and the dampers 70 can be simultaneously accommodated therein. Each leg portion 71 of the clamper 70 is separated from the flattened surface 43 of the terminal 42 of the halogen lamp 40 by the predetermined distance D, as shown in FIG. 7. As described above, the one ends of the leg portions 71 are bent outward after being fitted through the bottom wall of the clamping groove 51, to form the fixing lips 75.

In this second embodiment of the present invention, as for operation of the radiant electric heater, since it is the same as in the first embodiment, detailed explanation thereof shall be omitted. In this second embodiment, since the ceramic coating layer 61 is formed on the front surface of the auxiliary reflector 60, far infrared rays a2 are irradiated from the ceramic coating layer 61 in addition to the far infrared rays al from the ceramic base 50, whereby a far infrared ray irradiation efficiency is improved. Further, due to the fact that each of the leg portions 71 of the clamper 70 is separated from the flattened surface 43 of the terminal 42 of the halogen lamp 40 the predetermined distance D, the leg portions 71 can absorb vibration of the halogen lamp 40 even when shock is externally exerted to the halogen lamp 40. To enable this vibration absorbing function, the clamping groove 51 has a diameter which is greater than a diameter r1 of the halogen lamp 40. Of course, by the fact that an interval measured between the leg portions 71 is decreased at the other ends of the leg portions 71 to allow the leg portions 71 to be integrated with the clamping band portion 72 having the ring-shaped configuration for clamping the portion of the halogen lamp 40, which portion is adjacent to the terminal 42, the leg portions 71 primarily absorb, at the other ends of them, shock externally applied to the halogen lamp 40. In other words, when the halogen lamp 40 are vibrated (for example, in a direction represented by the reference symbol d1 or d2), although the clamping hand portion 72 is also vibrated together with the halogen lamp 40, this vibration is absorbed by the leg portions 71, whereby an improved shock-absorbing characteristic is obtained in the halogen lamp 40. When the terminals 42 are vibrated in a direction represented by the reference symbol e1 or e2 in FIG. 8, since the flattened surface 43 has a width which is the same as the diameter r1 of the halogen lamp 40, the flattened portion 43 can absorb shock along its widthwise direction. Namely, if the halogen lamp 40 is moved in the direction represented by the reference symbol d1 or d2, while the terminal 42 has a narrow shock absorbing area, the leg portions 71 of the damper 70 can reliably absorb shock. In this case, shock absorption by the leg portions 71 is enabled due to the fact that the clamping band portion 72 having the ring-shaped configuration for clamping the halogen lamp 40 is integrally formed with the other ends of the leg portions 71. Therefore, shock externally applied to the halogen lamp 40 is dispersed through the clamping band portion 72 over the leg portions 71, and according to this, the halogen lamp 40 can have a satisfactory shock-absorbing characteristic. While it was described in the above description that the halogen lamp has the U-shaped configuration, a person skilled in the art will readily understood that the present invention is not limited to the illustrated configuration of the halogen lamp but may have a diversity of configurations including an 11-shaped or cross-shaped one. The 11-shaped configuration means that the two halogen lamps are arranged in parallel.

As apparent from the above description, the radiant electric heater according to the present invention provides advantages in that, since a halogen lamp is utilized as heat generation means and clamped with respect to a ceramic base, installation of the halogen lamp can be easily implemented. Also, since radiant heat from the halogen lamp is applied to the ceramic base, a far infrared ray irradiation efficiency can be improved under a relatively low temperature, whereby an improved hyperthermic therapy effect can be rendered to a user. Further, by the fact that an auxiliary reflector is spacedly arranged in front of the halogen lamp in such a way as to ease an assembling work, a heat reflection efficiency is improved due to additional heat reflection by the auxiliary reflector. Moreover, by coating a front surface of the auxiliary reflector with a ceramic, a far infrared ray irradiation efficiency can be further improved. Furthermore, due to the fact that the halogen lamp is clamped with respect to the ceramic base by dampers in clamping grooves defined in the ceramic base and each of a pair of leg portions of each clamper is separated from the halogen lamp by a predetermined distance, a shock-absorbing characteristic of the halogen lamp can be improved. In addition, since a clamping band portion is integrally formed with the pair of leg portions in a manner such that each terminal of the halogen lamp is clamped by the clamping band portion to be capable of absorbing shock, the halogen lamp is kept from being damaged or broken into pieces, whereby durability and operational reliability of the entire radiant electric heater are improved.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A radiant electric heater, including a reflector, heat generation means disposed on the reflector, and a safety grill coupled to a front end of the reflector, comprising:

a ceramic base defined with clamping grooves for directly clamping terminals of a halogen lamp serving as the heat generation means, the ceramic base receiving radiant heat from the halogen lamp, being indirectly heated by the radiant heat and irradiating far infrared rays;

an auxiliary reflector arranged in front of the halogen lamp and having a concave surface outline which faces a curved front end of the halogen lamp, for primarily reflecting heat rays toward the reflector, the auxiliary reflector possessing a size capable of covering the curved front end of the halogen lamp; and a fastening member having one end which is affixed to the auxiliary reflector and the other end which is affixed to a center portion of the safety grill.

2. A radiant electric heater, including a reflector, heat generation means disposed on the reflector, and a safety grill coupled to a front end of the reflector, comprising:

a ceramic base defined with clamping grooves for directly clamping terminals of a halogen lamp serving as the heat generation means, the ceramic base receiving radiant heat from the halogen lamp, being indirectly heated by the radiant heat and irradiating far infrared rays;

an auxiliary reflector arranged in front of the halogen lamp and having a concave surface outline which faces a curved front end of the halogen lamp, for primarily reflecting heat rays toward the reflector, the auxiliary reflector possessing a size capable of covering the curved front end of the halogen lamp and being applied on a front surface thereof with a ceramic coating layer;

a fastening member having one end which is affixed to the auxiliary reflector and the other end which is affixed to a center portion of the safety grill; and clampers loosely accommodated, along with the terminals of the halogen lamp, in the clamping grooves of the ceramic base, for rendering a shock-absorbing characteristic to the halogen lamp;

each damper comprising a pair of leg portions accommodated in the clamping groove in such a way as to absorb shock, each separated by a predetermined distance from the terminal of the halogen lamp, and having one ends fixed to the ceramic base, and a clamping band portion integrally joined to the other ends of the leg portions and having a diameter which is less than an interval measured between the leg portions, for clamping a portion of the halogen lamp, which portion is adjacent to the terminal.

* * * * *